US006327427B1

(12) United States Patent
Burkett

(10) Patent No.: US 6,327,427 B1
(45) Date of Patent: Dec. 4, 2001

(54) SPACE HEATER AND ENCLOSURE

(75) Inventor: William W. Burkett, Rogersville, MO (US)

(73) Assignee: MHE Corp., Rogersville, MO (US)

( * ) Notice: Subject to any disclaimer, the term of this patent is extended or adjusted under 35 U.S.C. 154(b) by 0 days.

(21) Appl. No.: 09/596,192

(22) Filed: Jun. 16, 2000

(51) Int. Cl.[7] ..... F24H 3/00
(52) U.S. Cl. ..... 392/369; 392/375; 392/492
(58) Field of Search ..... 392/360, 363–369, 392/375, 376, 492, 410

(56) References Cited

U.S. PATENT DOCUMENTS

| | | | | |
|---|---|---|---|---|
| 1,006,767 | * | 10/1911 | Mauger | 392/410 |
| 1,534,571 | * | 4/1925 | Conning | 392/369 |
| 2,379,705 | * | 7/1945 | Graves | 392/410 |
| 2,527,013 | * | 10/1950 | Kjelgaard | 392/369 |
| 2,919,338 | * | 12/1959 | Covault et al. | 392/369 |
| 3,575,582 | | 4/1971 | Covault . | |
| 3,777,728 | | 12/1973 | Reiche . | |
| 4,052,593 | | 10/1977 | Ebert | 219/521 |
| 4,164,642 | | 8/1979 | Ebert . | |
| 4,197,447 | | 4/1980 | Jones . | |
| 4,307,284 | | 12/1981 | Perron . | |
| 4,309,594 | | 1/1982 | Jones . | |
| 4,680,448 | | 7/1987 | Fester . | |
| 4,835,367 | | 5/1989 | Hoffman . | |
| 4,900,898 | * | 2/1990 | Kling | 392/503 |
| 5,013,893 | | 5/1991 | Goessler et al. . | |
| 5,157,239 | | 10/1992 | Kanaya et al. | 219/411 |
| 5,568,586 | | 10/1996 | Junkel | 392/376 |
| 5,954,980 | | 9/1999 | Westerberg et al. . | |
| 5,990,460 | | 11/1999 | Petty et al. | 219/497 |
| 6,041,994 | | 3/2000 | Hwang et al. . | |

FOREIGN PATENT DOCUMENTS

| | | | |
|---|---|---|---|
| 2283810 | * | 5/1995 | (GB) . |
| 62-293029 | * | 12/1987 | (JP) . |
| 10-253163 | * | 9/1998 | (JP) . |
| 9210709 | * | 6/1992 | (WO) . |

* cited by examiner

*Primary Examiner*—John A. Jeffery
(74) *Attorney, Agent, or Firm*—Grace J. Fishel

(57) ABSTRACT

An electric space heater uses the heat generated by quartz-halogen lamps to heat air which may be supplied to heat a local space. The heater conducts air through a heater enclosure in which the lamps are installed. The air path is parallel to the longitudinal axis of the lamps. The air is warmed by conduction from the surface of the lamps and from heated walls surrounding the lamps and which form the air flow path. The walls are heated by radiation from the lamps. The flow path for the heated air and the placement of the heated walls substantially isolate the outer portion of the heater enclosure from the heat generated by the lamps to maintain the temperature of the outer surface of the space heater at or near ambient temperature. The walls also confine the light generated by the lamps to the interior of the space heater. The air flow through the space heater is assisted by an electric fan.

10 Claims, 6 Drawing Sheets

10
32
62
22
64
30
82
90
40
54
90
5
5
16
66
84
74
20
50
66
44
58
56
24
68

SPACE HEATER AND ENCLOSURE

BACKGROUND OF THE INVENTION

1. Field of the Invention

The present invention relates to the field of heaters that are used to heat generally small local spaces. In particular, this invention relates to such heaters that use electrical power as the heat source and especially this invention relates to such heaters that use light producing lamps as the heat generating elements.

2. Brief Description of the Prior Art

It is known to use small heat generating units to provide auxiliary heating for local spaces that do not receive sufficient heat from central heating units. These heating units are also used to provide heat when other heat sources are not available or to heat small spaces when it would not be justified to use a large central unit that would consume more power and heat more than the necessary space.

Space heaters have been constructed that generate heat by burning fuel or which generate heat from electrical power. Among those heaters using electrical power are those which use the heat from incandescent lamps as the heat source. The use of infra red lamps as a radiant heat source in bathrooms is common. It is also known in the art to use incandescent lamps, including infra red lamps, as the heat source in an enclosure through which air is passed and warmed. The warmed air is conducted to the space outside the enclosure to provide heat to that space.

The following U.S. Patents are known in the art and are incorporated by reference herein:

U.S. Pat. No. 3,575,582
U.S. Pat. No. 3,777,728
U.S. Pat. No. 4,052,593
U.S. Pat. No. 4,164,642
U.S. Pat. No. 4,197,447
U.S. Pat. No. 4,307,284
U.S. Pat. No. 4,309,594
U.S. Pat. No. 4,680,448
U.S. Pat. No. 4,835,367
U.S. Pat. No. 5,013,893
U.S. Pat. No. 5,157,239
U.S. Pat. No. 5,568,586
U.S. Pat. No. 5,954,980
U.S. Pat. No. 5,990,460
U.S. Pat. No. 6,041,994

BRIEF SUMMARY OF THE INVENTION

In view of the above, it is an object of the present invention to provide a space heater which uses an incandescent lamp to generate heat. It is another object to provide a space heater to heat air which is conducted through the space heater and which does not substantially heat the exterior of the space heater. It is also an object to provide a space heater which has an increased efficiency over space heaters using conventional incandescent lamps.

It is an object of the present invention to provide a space heater which uses quartz-halogen lamps to generate heat in the space heater. It is another object to provide a space heater which uses light generating lamps as a heat source and which confines the generated light to the interior of the space heater.

It is an object of the present invention to provide a space heater to heat air supplied to a local space. The space heater being in the form of an enclosure in which a quartz-halogen lamp heat source is mounted and having a path for air to be conducted through the enclosure with a part of the air path passing over the quartz-halogen lamp heat source parallel to the longitudinal axis of the quartz-halogen lamp heat source. Other objects and features of the invention will be in part apparent and in part pointed out hereinafter.

In accordance with the invention, a new space heater has improved efficiency in that it produces more usable heat in proportion to the amount of electricity consumed. The heater is an electrical heater which is enclosed and which heats air as the air is drawn through the enclosure. Heat is generated by one or more incandescent lamps which are preferably of the quartz-halogen type. The air path is designed to provide maximum heat transfer to the air, but to minimize the heat transferred to the enclosure to maintain the outer surface of the enclosure at ambient temperature or nearly so.

More preferably, the incandescent lamps are of the quartz-halogen type which use an iodine-inert gas fill surrounding a linear tungsten element. The element and fill are confined in a linear quartz tube which is spaced adjacent to the tungsten element. A suitable lamp is commercially available as a 500 watt, 120 volt lamp from Sylvania Corporation, as model 500 T3Q/CL-120V. It will be appreciated that equivalent lamps may be obtained from other suppliers and in other power and voltage specifications. The linear form of the lamps has been found to be especially preferred in this invention, as these lamps give very even heat transfer to the air which is conducted through the enclosure and which flows around the lamp parallel to the longitudinal axis of the lamp.

It another significant feature of the invention that, even though a substantial amount of light is generated by the lamp or lamps, no substantial amount of light escapes the enclosure of the space heater. This increases the value of the space heater, since it may be used in places where light is undesirable. For example, the space heater may be used in a bedroom, where light would disturb sleep, or in a photographic dark room, where light would interfere with photo development.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
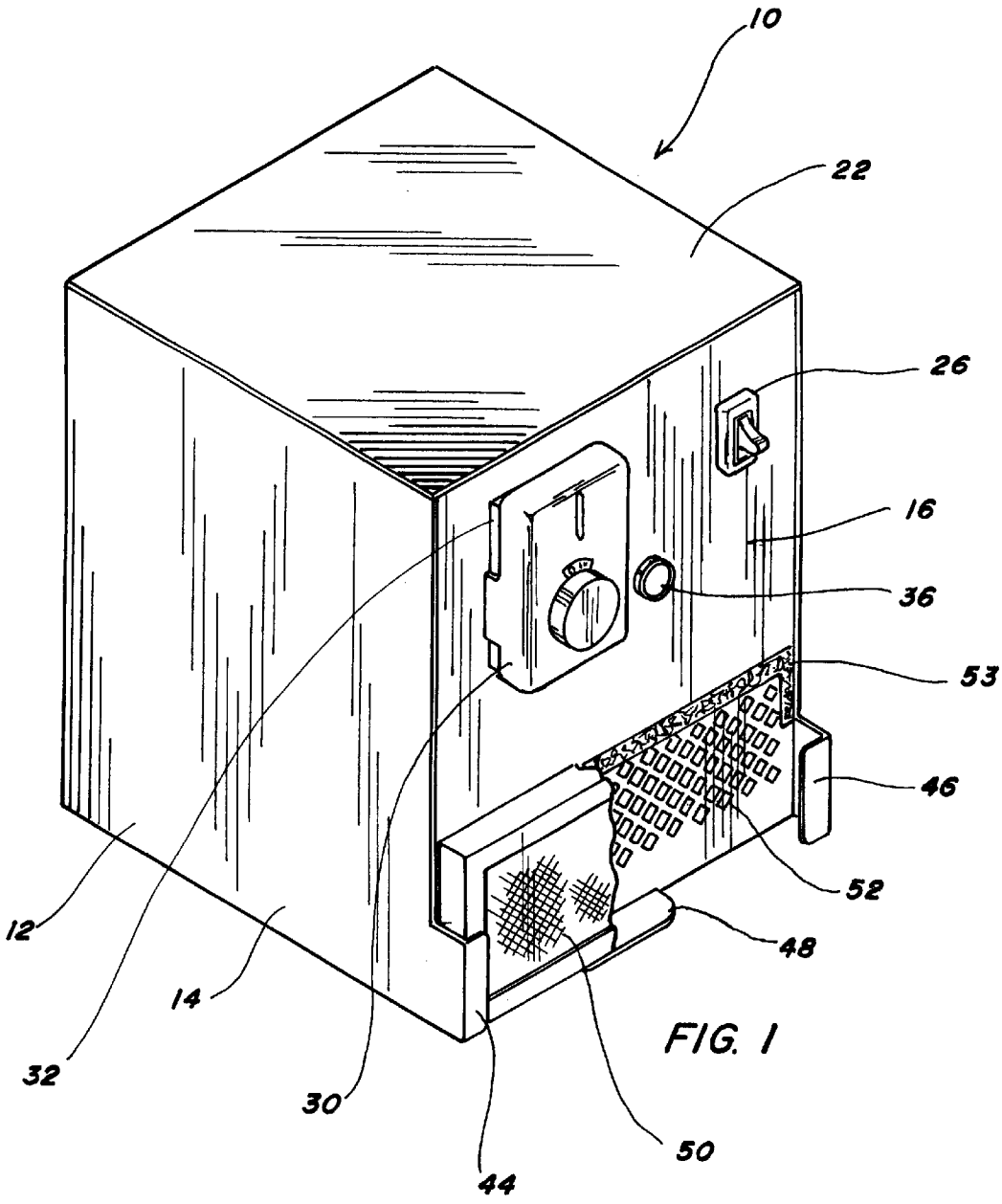
FIG. 1 is a perspective view of a space heater in accordance with the present invention.

Referring to the drawings more particularly by reference character, reference numeral 10 refers to a space heater according to the invention shown in FIG. 1. The space heater 10 is generally in the shape of a rectangular prism 12, as shown. The space heater 10 forms prism 12 with a series of external walls 14, 16, 18, and 20. The prism 12 is truncated by a top 22 and a bottom 24, to form the enclosure of the space heater 10. It will be appreciated that the walls, top and bottom of the space heater 10 will be formed of a durable material, for example aluminum or stainless steel sheet, or other equivalent material. The joinery may be by any conventional method, including welding, brazing and the use of fasteners, or combinations of methods as is known in the art.

Figure 2:
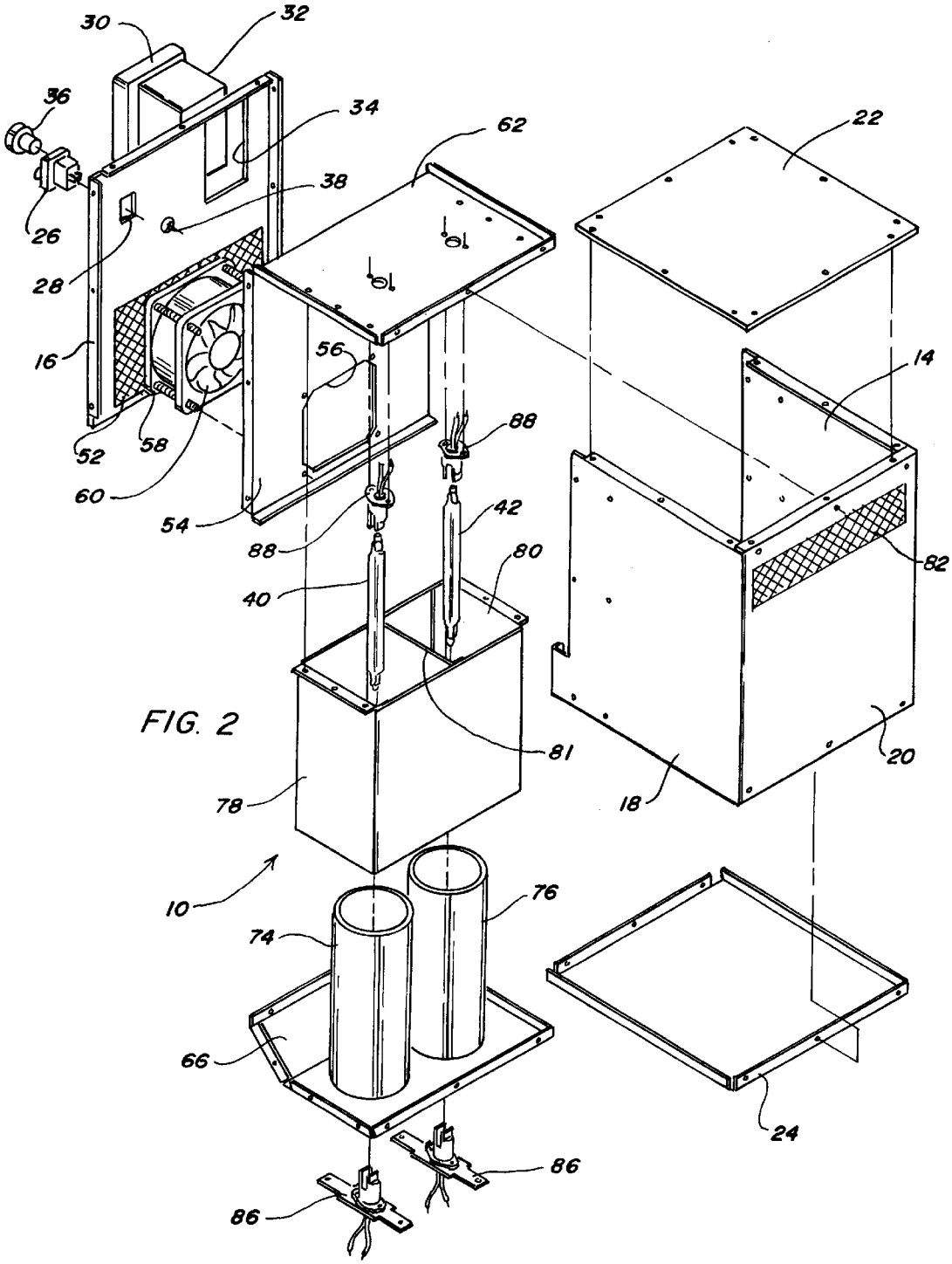
FIG. 2 is an exploded view of the space heater shown in FIG. 1.
Figure 4:
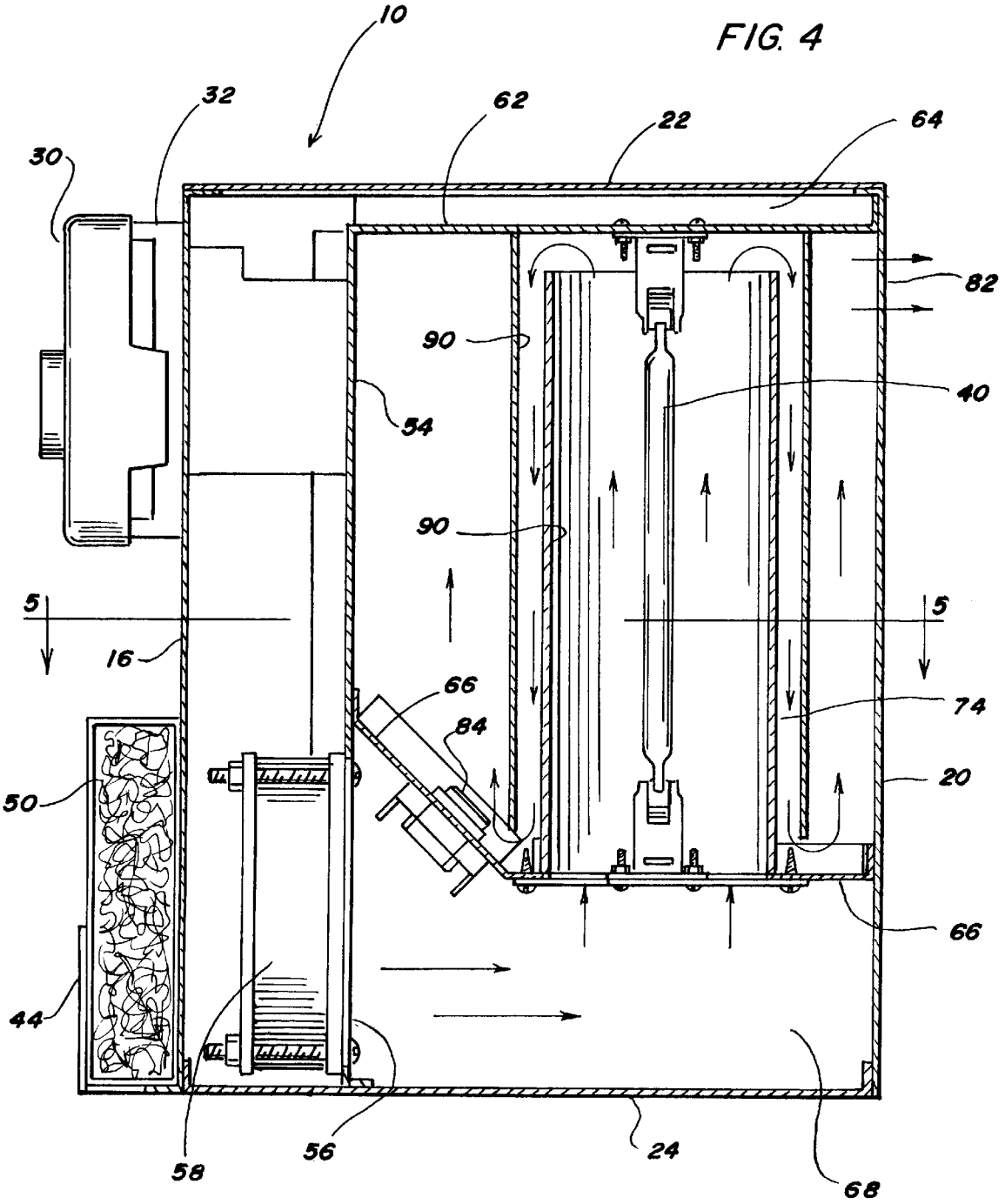
FIG. 4 is a right side view of the space heater shown in FIG. 1, in cross-section, taken along the plane 4—4 in FIG. 5.
Figure 5:
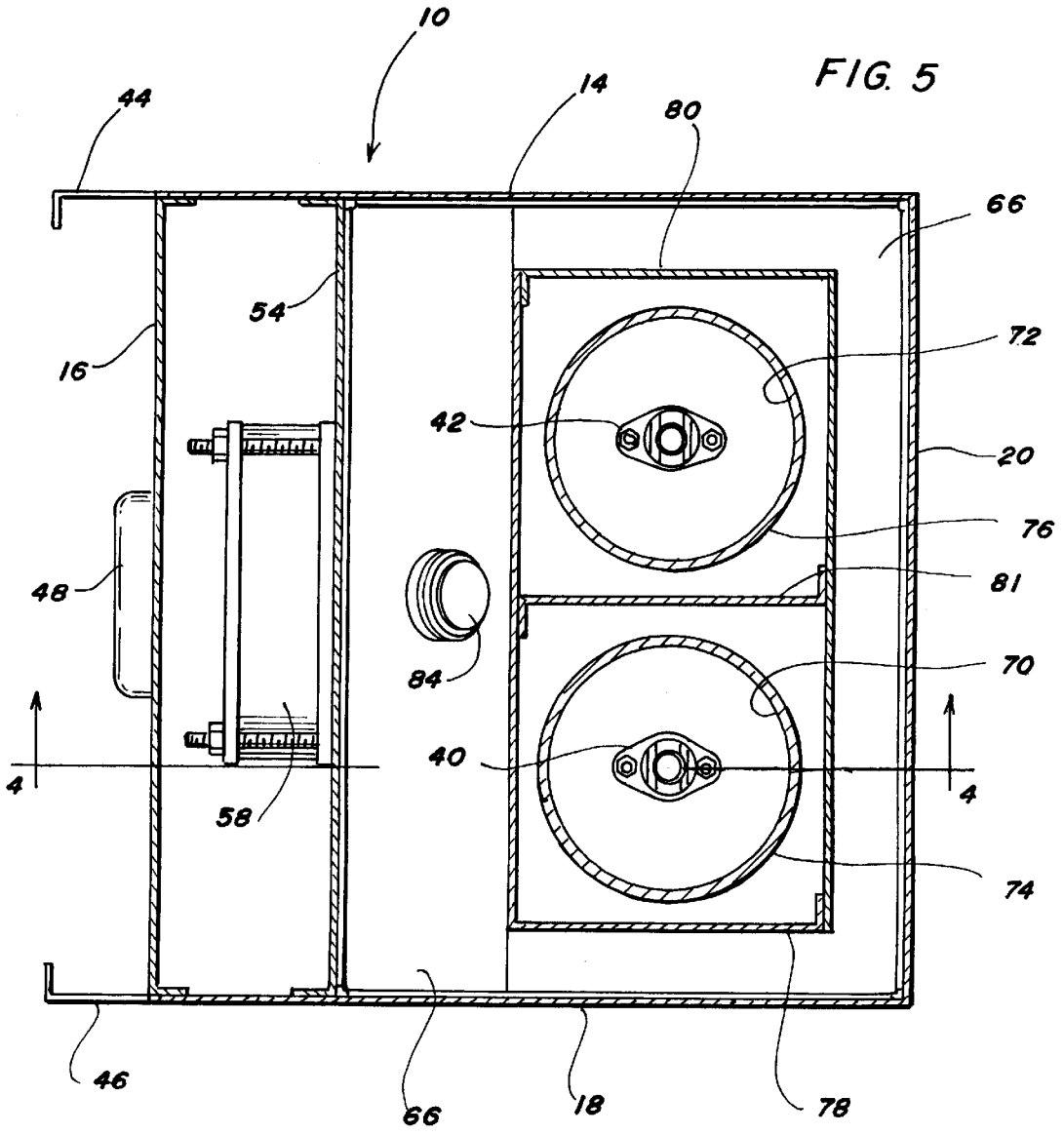
FIG. 5 is a top cross-sectional view of the space heater shown in FIG. 1, taken along the plane 5—5 in FIG. 4.
Figure 6:
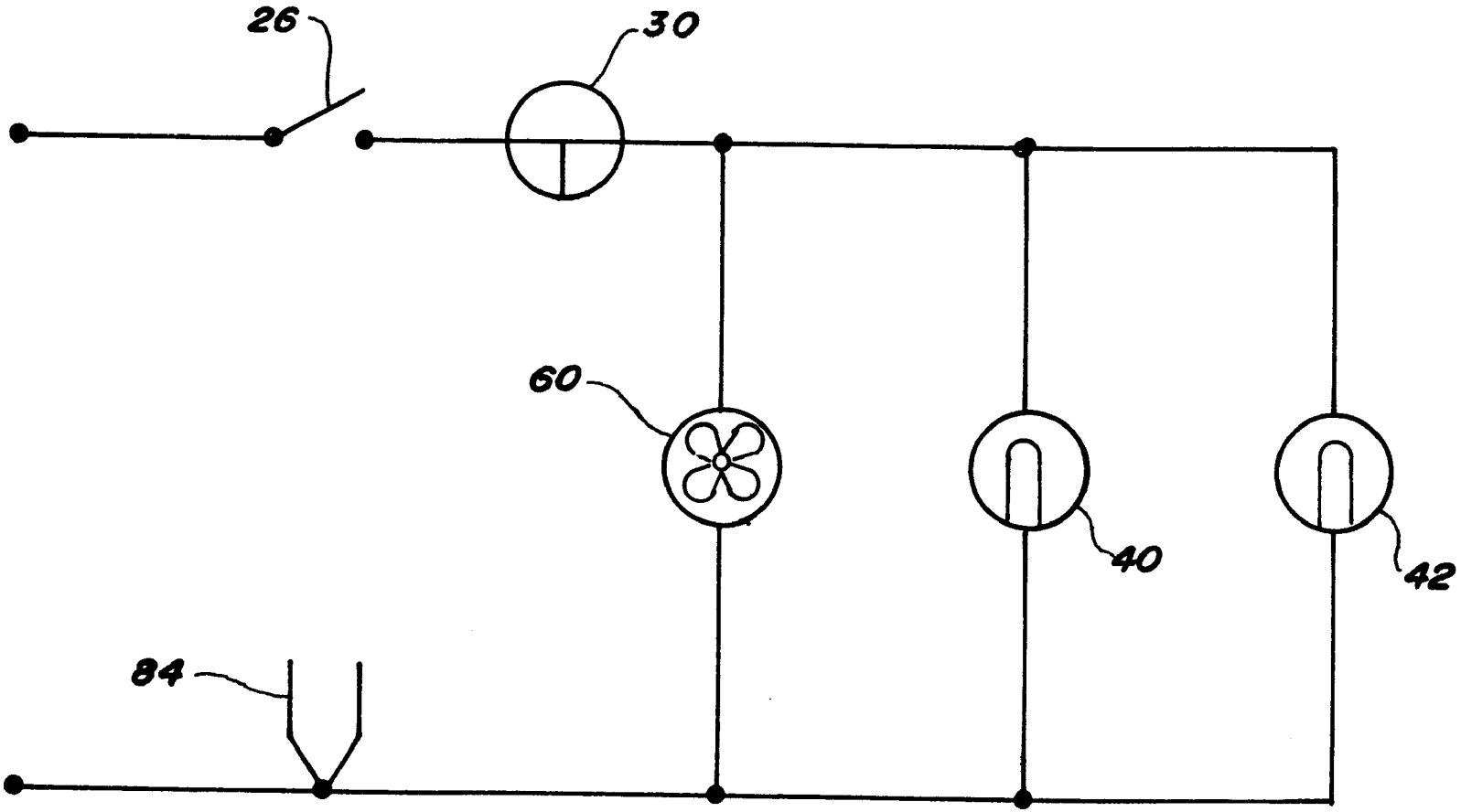
FIG. 6 is a schematic diagram showing a simplified electrical circuit for the lamps and controls of the space heater.

Wall 16 of the space heater 10 forms the back of the space heater. A conventional on-off electrical switch 26 is placed on wall 16, as shown. Switch 26 communicates with the interior of space heater 10 through opening 28, shown in FIG. 2. A variable thermostatic control 30 is mounted on wall 16, also as shown. Control 30 is mounted to plenum 32 and communicates with the interior of space heater 10 through opening 34, as shown in FIG. 2 and FIG. 4. If desired, space heater 10 may have a power cord strain relief 36 installed in a hole 38 in wall 16 for a power cord. Switch 26 and control 30 are electrically connected through their associated openings to cooperate with the heat generating lamps 40, 42, as known in the art, as described further herein and as shown in FIG. 6.

Figure 3:
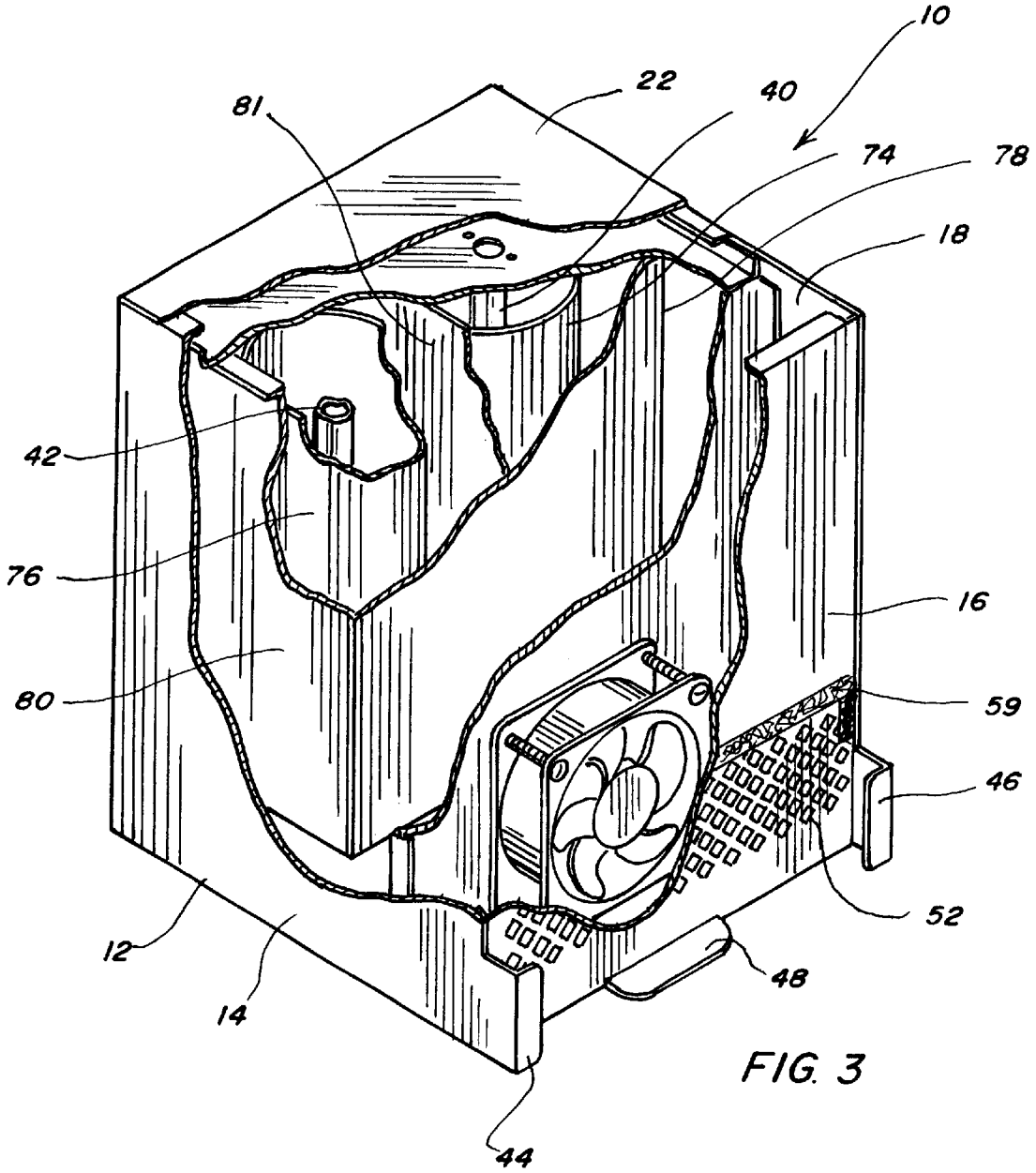
FIG. 3 is a broken view of the space heater shown in FIG. 1.

Turning to FIG. 1, walls 14 and 18 have forwardly extending projections 44 and 46, respectively. Wall 16 may also have a forwardly extending projection 48. Projections 44, 46 and 48 form a clip which may retain an air filter 50, shown partially broken in FIG. 1. Air filter 50 may be of conventional construction, for example fiberglass or equivalent material as is commonly used in furnace filters. It is preferred however that air filter 50 be a POLYTRON filter or equivalent. Wall 16 has a foraminous grill 52, shown in the lower portion of wall 16. Air filter 50 is held snugly over grill 52 by projections 44, 46 and 48, as shown. If desired, air filter 50 may be held to wall 16 by a conventional fastener, such as a VELCRO (TM) fastener strip 53, shown in FIG. 3, to provide a secure and snug fit of air filter 50 to wall 16. Grill 52 is the opening through which air enters the interior of the space heater 10. Air filter 50 is used, if desired, to remove debris and dust from the air to be heated. Air filter 50 thus keeps the interior of space heater 10 clean and prevents odors caused by heated dust.

The interior of space heater 10 has a circuitous air path defined by a series of partitions, tubes and ducts which guide the flow of air, as described herein. Vertical partition 54 is spaced behind wall 16 and is generally parallel to wall 16, as shown. Partition 54 has an opening 56 therein and a fan housing 58 is mounted over opening 56, as shown, using conventional fasteners. Fan and motor unit 60 is contained in housing 58 and is connected to a source of electrical power, as described herein.

Horizontal partition 62 joins the upper edge of vertical partition 54 and extends to front wall 20 and to side walls 14 and 18. Partition 62 is spaced downwardly from top 22 and forms an insulating dead air space 64 with top 22, as shown. A generally horizontal baffle 66 extends across the interior of space heater 10 at an intermediate location, as shown. Baffle 66 extends from vertical partition 54 to front wall 20 and to side walls 14 and 18. Baffle 66 is spaced from bottom 24, as shown, and forms a plenum 68 which guides the flow of air through space heater 10.

Baffle 66 has two openings 70 and 72 therein, as shown. Openings 70 and 72 communicate with plenum 68. Vertical tubes 74 and 76 are placed concentrically around openings 70 and 72 and are joined to baffle 66 at the edges of openings 70 and 72. Vertical tubes 74 and 76 extend upwardly from baffle 66 and terminate at a location spaced from horizontal partition 62, as shown. Ducts 78 and 80 extend downwardly from horizontal partition 62 and surround vertical tubes 70 and 72, and are spaced therefrom, as shown. Ducts 78 and 80 share a common side 81 and terminate at a location spaced above baffle 66.

The front wall 20 of the space heater 10 has a foraminous grill 82 in the upper portion of wall 20, as shown in FIG. 2. The openings in grill 82 provide an exit for air moving through the space heater 10 and complete the air path through the space heater 10. Baffle 66 may have a thermal overload thermostat 84 mounted thereon in the air path, as shown. Thermostat 84 may be set to disconnect the electrical components of the space heater 10 when the air in the interior of space heater 10 reaches a predetermined high value, such as 200 degrees F. The thermostat 84 may reset at a predetermined low value, such as 160 degrees F.

The heat in the space heater 10 is generated by a quartz-halogen lamp or lamps, in this embodiment shown as a pair of lamps 40 and 42. It will be understood that a single lamp may be used or that other multiples of lamps may be used depending on the power output of the lamp or lamps and the desired capacity of the space heater 10. As shown in FIG. 2, lamps 40 and 42 are positioned coaxially in tubes 74 and 76 and are also coaxially positioned with ducts 78 and 80. Lamps 40 and 42 are linear bulbs and when placed in tubes 74 and 76 have substantially the entire surface of lamps 40 and 42 exposed for heat transfer to the surrounding air and surrounding structure of the space heater 10. Lamps 40 and 42 are placed in suitable electrical fixtures 86 and 88, as shown, and are connected into the electrical circuitry of the space heater 10 by suitable wiring, as known in the art.

A schematic diagram for an electrical circuit for the space heater 10, using conventional 110 volt alternating line current, is shown in FIG. 6. In this circuit, heat generating lamps 40 and 42 are in parallel with each other and with the motor of fan and motor unit 60. The on/off switch 26 and the variable thermostat 30 are each in series with the array of lamps 40 and 42 and with the motor of fan and motor unit 60. The high temperature thermostat 84 is also in series with the array of lamps and fan motor. It will be appreciated that there are a variety of equivalent wiring configurations that would be suitable for the space heater of the invention, as is known in the art.

OPERATION OF THE DEVICE

In use, the space heater 10 of the invention is turned on by closing switch 26. Thermostat 30 samples the temperature of the ambient air surrounding the space heater 10 and if that temperature is below the setting of the thermostat 30, the circuit to lamps 40 and 42, and to the motor of fan and motor unit 60, is closed. The outer surfaces of quartz-halogen lamps 40 and 42 rapidly become hot due to the close proximity of the quartz tube to the internal tungsten filament of the lamps 40 and 42. The fan of fan and motor unit 60 draws the ambient air through filter 50 and grill 52 into the interior of space heater 10.

The air entering space heater 10 passes through fan and motor unit 60 into plenum 68, as shown by the arrows in FIG. 4. From plenum 68 the air passes through openings 70 and 72 into the interior of tubes 74 and 76, passing upwardly through tubes 74 and 76 and out of the tubes 74 and 76 into ducts 78 and 80, as shown. In ducts 78 and 80 the direction of the air is reversed to flow downwardly over tubes 74 and 76 and over the interior surfaces of ducts 78 and 80. When the air reaches baffle 66 its direction is again reversed to flow upwardly around the outer surfaces of ducts 78 and 80 and up through the interior of space heater 10, as shown. The temperature of the air exiting ducts 78 and 80 is sampled by high value thermostat 84. When the air flow reaches top partition 62 its direction is again changed to flow through exit grill 82 into the ambient surroundings.

The interior structure of the space heater 10 is preferably constructed of metals which are good heat conductors, such as copper or aluminum. In particular, tubes 74 and 76 and ducts 78 and 80 may use these materials. The surfaces of these structures are also preferably coated with a black body coating, such as a carbon black paint 90, to efficiently absorb radiant energy from lamps 40 and 42. As the air passes over lamps 40 and 42 it contacts substantially the entire surface of each of the lamps, longitudinally and about the 360 degree circumference of the lamps. The air is warmed by conduction from the intimate contact with lamps 40 and 42 and absorbs some heat radiated from the lamps. In addition, a portion of the radiated heat is absorbed by the material of tubes 74 and 76. This absorbed heat is in turn conducted to the air passing over both the interior and exterior surfaces of tubes 74 and 76. However, some of the heat absorbed by tubes 74 and 76 is radiated to the material of ducts 78 and 80 where it in turn is passed by conduction to the air passing through and around ducts 78 and 80. It will be appreciated that while the space heater 10 is shown with the lamps, tubes and ducts oriented primarily vertically, the operation of the device would remain substantially the same in many orientations which were not vertical.

With a fan which moves about thirty to thirty-five cubic feet per minute for each 500 watt lamp, or about sixty cubic feet per minute for the two lamp configuration shown in the drawings, the temperature of the air is raised about 105 degrees F. That is, with ambient air at seventy degrees F., the air exiting the space heater 10 is about 175 degrees F. This is an increase of about fifteen degrees F. over conventional heater designs using incandescent lamps and operating with the same power consumption. Moreover, the temperature of the external surfaces of the space heater 10 is not substantially changed from the temperature of the ambient air. In particular, back wall 16 and top 22 do not experience a substantial change in temperature. This feature could permit the space heater 10 to be incorporated into other structures, such as an end table or other furniture, for example. Further, the circuitous path of the air and the enclosing structure act as a black body, effectively confining the bright light produced by the lamps 40 and 42, so that no light escapes from the enclosure of the space heater 10.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A space heater for heating a portion of air taken from ambient air surrounding the heater comprising an enclosure, the enclosure having an air inlet for ambient air and an air outlet for heated air, the space heater having a fan, the fan communicating with the air inlet and the air outlet and providing movement to the air to convey cool ambient air into the enclosure and heated air out of the enclosure into the ambient surrounding air, the space heater further having a heat source mounted in the enclosure, the heat source generating heat from electrical power, the heat source including a linear quartz-halogen incandescent lamp mounted in the enclosure, the enclosure having a guide element to direct the flow of air through the enclosure, the guide element directing the flow of air through the enclosure and confining the air into intimate contact with the surface of the quartz-halogen lamp whereby efficient transfer of heat from the lamp to the air is achieved, said guide element including a guide portion, a guide member, a first and a second baffle, said guide portion at least partially encircling the quartz-halogen lamp around the circumference of the quartz-halogen lamp, spaced from the surface of the quartz-halogen lamp and extending substantially along the longitudinal extent of the quartz-halogen lamp for directing the flow of air along the surface of the quartz-halogen lamp, said guide member at least partially encircling the guide portion, spaced from the guide portion and extending substantially along the longitudinal extent of the guide portion, said first baffle being spaced from the guide portion and extending at least partially transverse of the guide portion for reversing the direction of the air flowing through the guide portion and directing it between the guide portion and the guide member, said second baffle being spaced from the guide member for reversing the direction of the air flowing between the guide portion and the guide member and directing it towards the air outlet, whereby the guide element substantially confines the light generated by the quartz-halogen lamp to the enclosure so that no light escapes from the enclosure through the air outlet.

2. The space heater of claim 1 wherein the space heater includes a plurality of quartz-halogen lamps in the heat source.

3. The space heater of claim 1 wherein the space heater enclosure has an outer wall, the outer wall having the inlet therein, the enclosure also having a first partition spaced from the wall and extending substantially parallel thereto, the first partition having an opening therein and wherein the fan is mounted in the opening.

4. The space heater of claim 3 wherein the second baffle joins the first partition at an edge of the second baffle and forms a plenum through which the ambient air flows as the ambient air is conveyed to the quartz-halogen lamp to be warmed thereby.

5. The space heater of claim 4 wherein the space heater has a top with an outer top surface and the space heater has a second partition in the enclosure, the second partition being spaced from the top and extending substantially parallel thereto, the second partition serving as the first baffle and with the top forming an insulating space in the enclosure at least partially isolating the top of the space heater from the heat generated in the enclosure.

6. The space heater of claim 1 wherein the guide element is at least partially constructed of a heat conducting metal.

7. The space heater of claim 1 wherein the guide element is at least partially coated with a heat absorbing coating.

8. The space heater of claim 1 wherein the guide element is at least partially coated with a black body radiant energy absorbing coating and wherein the guide element at least partially isolates the heat generated by the quartz-halogen lamp from a part of the space heater.

9. A space heater for heating a portion of air taken from ambient air surrounding the heater comprising an enclosure, the enclosure having an air inlet for ambient air and an air outlet for heated air, the space heater having a fan, the fan communicating with the air inlet and the air outlet and providing movement to the air to convey cool ambient air into the enclosure and heated air out of the enclosure into the ambient surrounding air, the space heater further having a heat unit mounted in the enclosure, the heat unit generating heat from electrical power, the heat unit including a quartz-halogen incandescent lamp mounted in the enclosure, the quartz-halogen lamp being substantially in the form of a linear tube having a longitudinal axis and having a 360 degree circumference, the enclosure having a bottom and having a baffle therein, the baffle being spaced from the bottom and extending at least partially horizontally across the enclosure, the enclosure having an outer wall, the outer wall having the inlet therein, the enclosure also having a vertical partition therein, the vertical partition being spaced from the outer wall and extending substantially parallel thereto, the vertical partition having an opening therein and the fan being mounted in the opening, the vertical partition and the baffle being joined at an edge of the baffle and forming a plenum through which the ambient air flows as the ambient air is conveyed to the heat unit, the baffle having a circular opening there through, the heat unit having a vertical tube positioned above the baffle and communicating with the plenum through the tube extending vertically up from the baffle and being joined to the baffle at the periphery of the circular opening, the quartz-halogen lamp being mounted in the tube and being coaxial therewith whereby ambient air may flow from the plenum through the tube in intimate contact with the surface of the quartz-halogen lamp over a substantial portion of the longitudinal and circumferential extent of the quartz-halogen lamp, the space heater having a top with an outer top surface and having a substantially horizontal partition in the enclosure, the horizontal partition being spaced from the top, the heat unit having a duct attached to the horizontal partition and extending downwardly therefrom, the duct being placed around the vertical tube and being coaxial therewith, the duct extending downwardly to a location adjacent to the baffle and terminating at a location spaced above the baffle, the vertical tube extending upwardly to a location adjacent to the horizontal partition and terminating at a location spaced below the horizontal partition, the heat unit being at least partially constructed of heat conduction metal and being at least partially coated with a radiant energy absorbing coating whereby the heat unit may efficiently transfer heat from the quartz-halogen lamp to the air as the ambient air flows from the plenum, through the tube and through the duct, the duct communicating with the air outlet to supply the heated air to the surroundings whereby the vertical tube, the battle, the horizontal partition, and the duct confines the light generated by the quartz-halogen lamp to the enclosure so that no light escapes from the air outlet.

10. The space heater of claim 9 wherein the space heater has a plurality of heat units.

* * * * *